US012325831B2

(12) United States Patent
Alhumud et al.

(10) Patent No.: US 12,325,831 B2
(45) Date of Patent: Jun. 10, 2025

(54) COMPACT STATIC HIGH-PRESSURE, HIGH-TEMPERATURE GAS OIL SEPARATION PLANT SYSTEMS AND METHODS

(71) Applicant: SAUDI ARABIAN OIL COMPANY, Dhahran (SA)

(72) Inventors: Abdulrahman Alhumud, Dammam (SA); Samusideen Adewale Salu, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 104 days.

(21) Appl. No.: 18/316,875

(22) Filed: May 12, 2023

(65) Prior Publication Data

US 2024/0376389 A1 Nov. 14, 2024

(51) Int. Cl.
*C10G 53/02* (2006.01)

(52) U.S. Cl.
CPC ..... *C10G 53/02* (2013.01); *C10G 2300/1033* (2013.01); *C10G 2300/205* (2013.01); *C10G 2300/207* (2013.01); *C10G 2300/208* (2013.01); *C10G 2300/30* (2013.01); *C10G 2300/4081* (2013.01)

(58) Field of Classification Search
CPC ..... C10G 53/02; C10G 2300/1033; C10G 2300/205; C10G 2300/207; C10G 2300/208; C10G 2300/30; C10G 2300/4081
See application file for complete search history.

(56) References Cited

U.S. PATENT DOCUMENTS

2018/0066194 A1* 3/2018 Soliman ..... C10G 31/06

OTHER PUBLICATIONS

Soliman, Mohamed Ahmed, Salu, Samusideen, Al-Zahrani, Talal, and Nisar Ansari. "Innovative Integrated and Compact Gas Oil Separation Plant for Upstream Surface Facilities." Paper presented at the Offshore Technology Conference, Houston, Texas, USA, May 2020.

* cited by examiner

*Primary Examiner* — Ellen M McAvoy
*Assistant Examiner* — Chantel Graham
(74) *Attorney, Agent, or Firm* — Vorys, Sater, Seymour and Pease LLP

(57) ABSTRACT

A compact pressure energy conservation gas oil separation plant system includes an inline separator device (ILS) that receives a wild crude oil and separates at least 95% of free gas and free water from the wild crude oil and discharges an ILS outlet crude stream, a wet-dry heat exchanger for heating the ILS outlet crude stream, thereby producing an exchanger outlet crude stream, a three-phase high-pressure-high-temperature (HPHT) separator that receives and separates gas and water from the exchanger outlet crude stream to achieve a Basic Sediment & Water specification of 0.2 v/v % or less, thereby producing an HPHT outlet crude stream, a high-pressure desalter and dehydrator (HPDD) that receives, desalts, and dehydrates the HPHT outlet crude stream, thereby further and producing an HPDD outlet crude stream, and a high-pressure stabilization column (HPSC) that receives and stabilizes the HPDD outlet crude stream, thereby producing an export grade crude stream.

20 Claims, 2 Drawing Sheets

COMPACT STATIC HIGH-PRESSURE, HIGH-TEMPERATURE GAS OIL SEPARATION PLANT SYSTEMS AND METHODS

FIELD OF THE DISCLOSURE

The present disclosure relates generally to processing crude oil from an oil well and, more particularly, to compact static high-pressure, high-temperature gas oil separation plant systems and methods.

BACKGROUND OF THE DISCLOSURE

Gas oil separation plant (GOSP) systems are often employed in the upstream oil and gas industry to process raw multiphase crude oil obtained from oil wells. Such raw crude oil includes a mixture of liquid hydrocarbons, gas, and saline (salt) formation water. The main function of GOSP systems is to adequately treat the raw multiphase crude oil by separating the gas and saline formation water from the liquid hydrocarbons to acceptable specifications for effective transportation and downstream processing. For example, excessive salt and water in crude oil can result in high corrosion of transportation pipelines and refining units, and can also have detrimental scaling effects on processing units and catalysts. Furthermore, unstable crude oil can result in high vaporization in transportation vessels during shipping across regions of high temperature, leading to the potential of catastrophic explosion and major pollution to marine environments.

Conventional GOSP systems typically require a multitude of process equipment arranged in series and flow line requirements, resulting in the need for large energy requirements, operational and maintenance costs, and large and costly facilities to house GOSP systems.

What is needed is an alternative GOSP system that alleviates the aforementioned disadvantages associated with conventional GOP systems while meeting acceptable specifications for effective transportation and downstream processing.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a compact high-pressure high-temperature gas oil separation plant system is provided, the system including an inline separator device (ILS) that receives a wild crude oil and separates a portion of gas and water from the wild crude oil and discharges an ILS outlet crude stream; a wet-dry heat exchanger for heating the ILS outlet crude stream, thereby producing an exchanger outlet crude stream; a three-phase high-pressure high-temperature (HPHT) separator that receives and separates gas and water from the exchanger outlet crude stream to achieve a Basic Sediment & Water specification of 0.2 v/v % or less, thereby producing an HPHT outlet crude stream; a high-pressure desalter and dehydrator (HPDD) that receives, desalts, and dehydrates the HPHT outlet crude stream, thereby further and producing an HPDD outlet crude stream; and a high-pressure stabilization column that receives and stabilizes the HPDD outlet crude stream, thereby producing an export grade crude stream.

According to an embodiment consistent with the present disclosure, a method is provided, the method including introducing a wild crude oil to an inline separator device (ILS) and thereby operating the ILS to separate a portion of gas and water from the wild crude oil and produce an ILS outlet crude stream; conveying the ILS outlet crude stream through a wet-dry heat exchanger and thereby heating the ILS outlet crude stream and producing an exchanger outlet crude stream; separating gas and water from the exchanger outlet crude stream in a three-phase high-pressure high-temperature (HPHT) separator and thereby producing an HPHT outlet crude stream that exhibits a Basic Sediment & Water specification of 0.2 v/v % or less; desalting and dehydrating the HPHT outlet crude stream in a high-pressure desalter and dehydrator (HPDD) and thereby producing an HPDD outlet crude stream; stabilizing the HPDD outlet stream in a high-pressure stabilization column (HPSC); and discharging an export grade crude stream from the high-pressure stabilization column.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
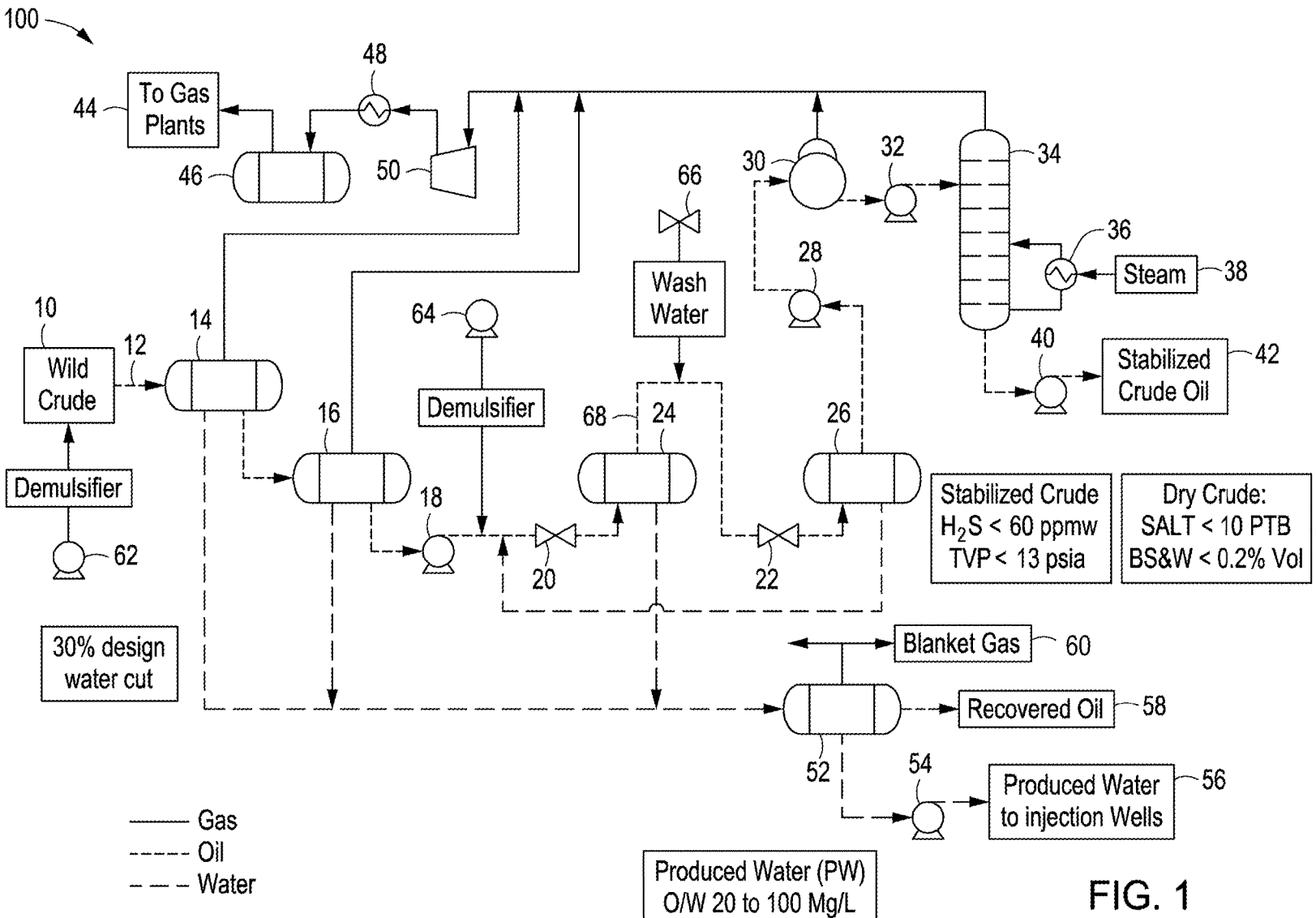
FIG. 1 (PRIOR ART)
FIG. 1 is a simplified, schematic diagram of a conventional (prior art) GOSP system.

Embodiments of the present disclosure will now be described in detail with reference to the accompanying Figures. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to processing crude oil from an oil well and, more particularly, to compact static pressure energy retention gas oil separation plant systems and methods. Such static pressure energy retention gas systems are compact high-pressure, high-temperature (HTHP) gas oil separation plant (GOSP) systems. The HTHP-GOSP systems of the present disclosure utilize minimal equipment, including static pressure vessel equipment and a pressure vessel 3-phase separator that interfaces with a crude trunk line.

The HPHT-GOSP systems of the present disclosure separate feed (wild) crude oil into its gas and liquid phases (gas and oil), while conserving the high pressure of the feed crude without any or any significant (less than 30%) letting down. The conserved pressure energy may be utilized in transporting the separated fluids to one or more desired destinations. Moreover, the HPHT-GOSP systems of the present disclosure can utilize renewable sources of energy, such as solar concentration with molten salt technology, to provide the necessary crude heating to increase feed crude temperature to achieve separation thereof.

The HPHT-GOSP systems of the present disclosure advantageously reduce both project capital expenditure (CAPEX) and operating expenditure (OPEX); reduce plant processing equipment count; eliminate major rotating equipment that requires substantial energy input; and reduce the shearing effect of oil-water emulsions in energy dissipation as pressure drops across pressure reduction valves in the system, thereby promoting case and reduce expense related to water separation of a feed crude.

Prior Art GOSP System

Before describing the HPHT-GOSP systems and methods of the present disclosure, a simplified, schematic conventional (prior art) GOSP system 100 is described with reference to FIG. 1. The GOSP system 100 (hereafter the "GOSP 100") may be configured to receive and process crude oil and, more particularly, to remove hydrocarbon gas and water from the incoming crude oil.

GOSP 100 receives wild/wet crude 10 from an upstream field (e.g., an oil well) via a trunk line 12 that feeds the crude into a three-phase separation vessel, such as a High Pressure Production Trap (HPPT) separator 14, where the first stage of gas and free water separation from the crude 10 takes place. The separated wet crude discharged from the HPPT 14 is fed into a second stage three-phase separation vessel, such as a Low Pressure Production Trap (LPPT) separator 16 for further separation of more gas and water from the crude at a lower pressure. In some example configurations of the GOSP 100, the wet crude from the LPPT 16 may also be channeled through one or more wet/dry heat exchanger(s) into a three-phase Low Pressure Degassing Tank (LPDT) or separator that normally operates at almost atmospheric pressure (circa 3 psig) for more gas and water to be removed from the wet crude 10. It should be noted, however, that the two additional unit operations, for example, wet/dry heat exchanger and LPDT are not shown in the GOSP illustrated in FIG. 1 as they are considered optional.

The wet crude oil from the LPPT 16 (or LPDT) is transferred by one or more crude charge pumps 18 into Wet Crude Handling Facilities (WCHF) via mixing valves 20 and 22. The WCHF may include a Wet Crude Handling (WCH) dehydrator 24 and a single/double stage WCH desalter 26. The crude 10 must be treated in the WCHF to meet first the Basic Sediment & Water (BS&W) specification of 0.2 v/v % or less and then the salt content of less than 10 PTB (pounds per thousand barrels). The dehydrated/desalted crude is then pumped into an atmospheric spheroid or degassing tank 30 via shipper pump 28 and then flows to a crude stabilizer column 34 via booster pump 32, where it is stripped of volatile components and stabilized to export grade crude specification of 13 TVP (True Vapor Pressure) at 130° F. and its $H_2S$ content removed to a required specification of less than 60 ppm wt. (parts per million by weight) $H_2S$. Optionally, steam 38 may be injected into the crude after emerging from a reboiler 36 and before entering into the crude stabilizer 34.

The produced export grade crude or stabilized oil 42 is finally pumped by one or more shipper pumps 40 to its export terminal or refinery destination. The gas streams from the production traps 14, 16, degassing tank 30, and stabilizer 34 flow to the gas gathering compression system for onward delivery to gas processing plants 44.

Each stage of the compression plant consists of a gas compressor 50, a compressor discharge cooler 48, and a compressor discharge gas knock-out vessel 46.

The water streams from the productions traps 14, 16 and the WCH dehydrator 24 is pumped to a Water Oil Separator (WOSEP) 52, where the WOSEP 52 separates water 56 from recovered oil 58. Blanket gas 60 is used to maintain normal operating pressure in the WOSEP 52. The WOSEP 52 removes the oil content of inlet-produced water to less than 100 ppm at the outlet as the disposal water, which is injected, via an injection pump 54, back downhole (e.g., into a reservoir) for water flooding and pressure maintenance.

As shown in FIG. 1, there are two points 62, 64 for demulsifier injection in the GOSP 100. The first injection point 62 is upstream of the high-pressure production trap 14 at the inlet 12 of the plant which is referred to as the primary demulsifier injection. The second injection point 64 is upstream of the Wet Crude Handling Facilities 24, 26, which is referred to as secondary/emergency demulsifier injection. Wash water 66 is injected into the dehydrated crude 68 entering the desalter 26 to meet the salt content specification of the produced crude.

Accordingly, in conventional GOSP systems, a feed (wild) crude oil is separated into its gas and liquid phases (gas and oil) by stage-wise letting down of the upstream pressure in a series of vessels, recompression of the separated gases in a similar series of compressor stages, and pumping the separated liquid for export to desired destinations. Thus, conventional GOSP systems require installation of a series of various equipment, such as separation vessels, rotating equipment (pumps, compressors, etc.), and the like, that require substantial energy consumption to operate. The prior art GOSP systems further disadvantageously requires a large foot print area requirement, translating (1) to major asset costs, particularly in offshore facilities, (2) relatively low plant reliability and availability values due to the presence of a multitude of rotating equipment, and (3) relatively large greenhouse emissions and associated negative environmental consequences.

The HPHT-GOSP System

Unlike the conventional GOSP system 100, and as described above, the compact high-pressure, high-temperature gas oil separation plant (HPHT-GOSP) systems of the present disclosure achieve near-zero energy consumption. As used herein, the term "near-zero energy consumption," and grammatical variants thereof refers to about or equal to one-millionth ($1\times10^{-6}$) of the energy requirement of a conventional GOSP. That is, the HPHT-GOSP of the present disclosure will require about or equal to one-millionth of the energy consumption of a conventional GOSP.by eliminating major rotating equipment such as pumps and compressors, minimizing the amount of process equipment, eliminating any or any significant letting down pressure, and utilizing renewable sources of energy to meet industry separation standards for separation of water and gas from liquid oil in a feed (wild) crude.

Figure 2:
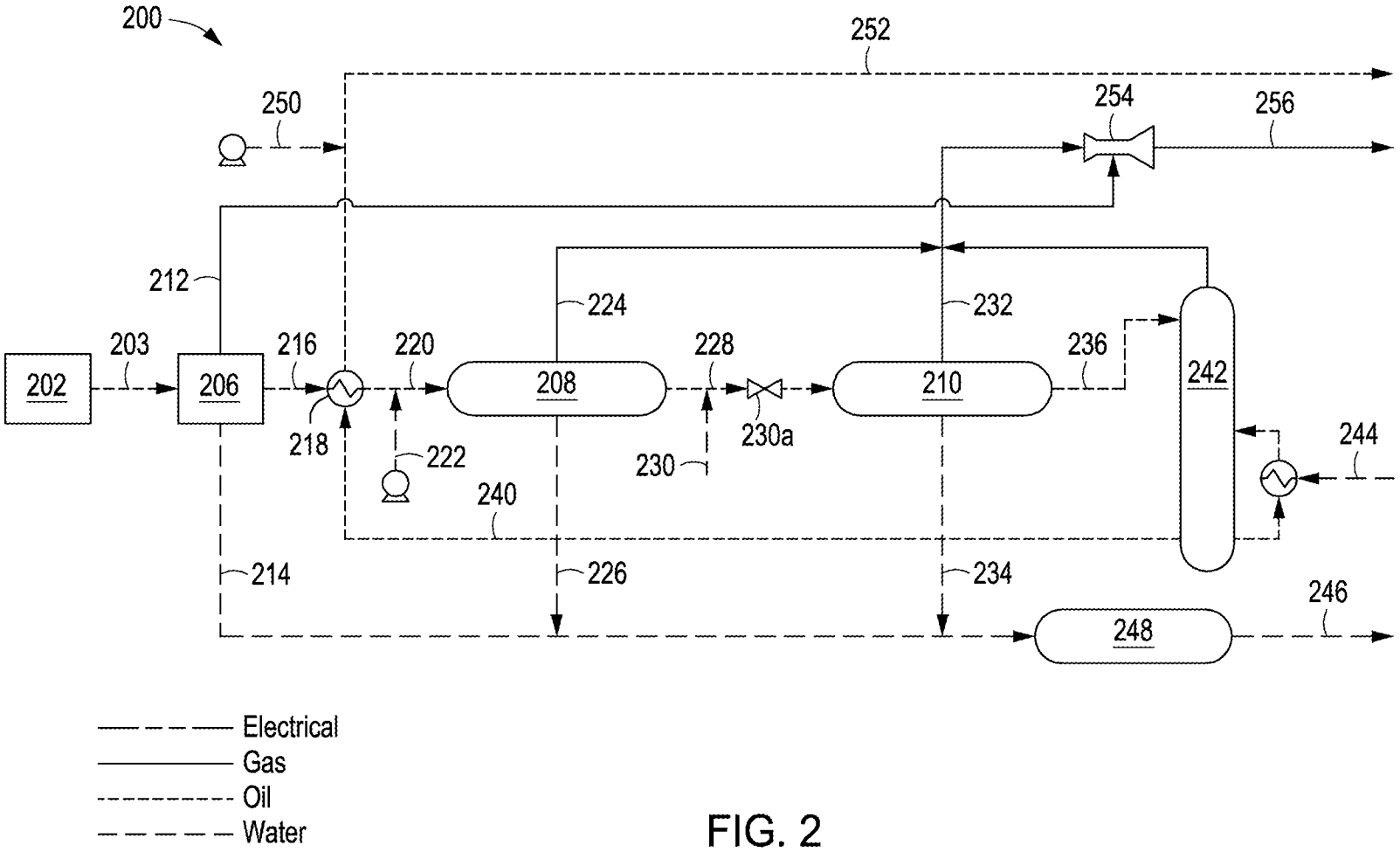
FIG. 2 is a schematic diagram of an example HPHT-GOSP system, according to one or more embodiments.

Referring now to FIG. 2, illustrated is a schematic of an example HPHT-GOSP system 200, according to one or more aspects of the present disclosure. The HPHT-GOSP system 200 (hereafter the "HPHT-GOSP 200") may be similar in some respects to the GOSP 100, and therefore may be best understood with reference thereto. The HPHT-GOSP 200 receives a multiphase feed wild/wet crude stream 202 from an upstream field (e.g., an oil well) via a trunk line 203. The HPHT-GOSP 200 separates the wild/wet crude stream 202 from associated gas and water using an inline separator device (ILS) 206 (e.g., a cyclonic type of inline multiphase separator), a three-phase high-pressure high-temperature (HPHT) separator 208 equipped with Vessel Internal Electrostatic Coalescer (VIEC), and a combined high-pressure desalter and dehydrator (HPDD) 210 equipped with a VIEC as well. As used herein, the term "Vessel Internal Electrostatic Coalescer" or "VIEC," and grammatical variants thereof, refers to a technology using alternating high voltage electrical fields for enhancing liquid-liquid separation by Wartsila Corporation of Helsinki, Finland.

Initially, the wild/wet crude stream 202 is fed to the ILS 206, thereby producing an ILS outlet gas stream 212, an ILS outlet water stream 214, and an ILS outlet wet crude stream 216 (i.e., separation of the feed wild/crude stream 202). It is to be noted that the feed wet/crude stream 202 is relatively cold, having a temperature in the range of about 60° F. to about 160° F., and encompassing any value and subset therebetween. In a specific example, the temperature of the feed wild/crude stream 202 is about 150° F.

The ILS 206 also operates as a slug catcher and production trap, equipped with adequate industry requirements for slug management. That is, the ILS 206 may be a three-phase separator that includes a phase separator to separate gas, water, and wet crude oil and a second phase that operates as a storage vessel to contain liquid slug. As used herein, the term "slug," and grammatical variants thereof, refers to a volume of fluid, mainly liquid, generally of a higher density, than the main body of fluid that exits a pipeline.

With continued reference to FIG. 2, after the ILS 206 processes the wild/crude stream 202, the resultant ILS outlet wet crude stream 216 may be fed through a wet-dry heat exchanger 218 to produce a higher-temperature, exchanger outlet wet crude stream 220. The wet-dry heat exchanger 218 serves to cross-exchange heat with a relatively hot stabilized crude stream 240 discharged from a high-pressure crude stabilizer 242, as described in more detail below, for export to an export terminal, pipeline, or refinery destination, as also described herein. The wet-dry heat exchanger 218 may serve advantageously as a heat economizer, wherein the relatively cold ILS outlet wet crude stream 216 (i.e., see temperature range provided above for the feed wild/crude stream 202) is heated by the stabilizer outlet wet crude stream 240, as required to enhance gas and emulsion water separation in subsequent process equipment. Further, the relatively hot stabilizer outlet wet crude stream 240 must be cooled to meet the pipeline and downstream (terminal/refinery) tank specifications.

Upon emerging from the wet-dry heat exchanger 218, the exchanger outlet wet crude stream 220 may have a temperature in the range of about 200° F. to about 240° F., and encompassing any value and subset therebetween. In some aspects, upon emerging from the wet-dry heat exchanger 218, the exchanger outlet wet crude stream 220 may have a temperature of about 230° F. The elevated temperature permits thermodynamic separation in a high-pressure, high-temperature 3-phase separation vessel (HPHT separator 208) of gas from the outlet wet crude stream 220 of in the range of 90% to 95%, which may be determined according to process simulation software, such as ASPEN-HYSYS (AspenTech, Massachusetts).

Upon emerging from the wet-dry heat exchanger 218 and prior to being fed into the HPHT separator 208, in some embodiments, the exchanger outlet wet crude stream 220 may be dosed with a demulsifier 222. Demulsifier(s) 222 are chemicals used to separate emulsions, such as water-in-oil emulsions. An example of a suitable demulsifier 222 for use in the present disclosure includes, but is not limited to, PHASETREAT® (Clariant of Muttenz, Switzerland). In one or more instances, the demulsifier 222 may be added to the exchanger outlet wet crude stream 220 in an amount in the range of about 20 ppm vol (parts per million by volume) to about 50 ppm vol, encompassing any value and subset therebetween, depending on the type of feed wild/crude stream 202, for example.

The exchanger outlet wet crude stream 220, dosed optionally with the demulsifier(s) 222, may be fed into the HPHT separator 208 to produce an outlet gas stream 224, an outlet water stream 226, and an outlet wet crude stream 228. The HPHT separator 208 may be operable to separate in-solution gases to achieve gas separation of the resultant outlet wet crude stream 228 in an amount of up to about 95%, without letting down fluid arrival pressure and using temperature increase to achieve gas separation. Moreover, in embodiments where the HPHT separator 208 includes the VIEC, the HPHT separator 208 may also be operable to separate both free water and water-in-emulsion (i.e., water-in-oil) due to the inclusion of the demulsifier 222. The HPHT separator 208 is further capable of achieving water separation meeting BS&W specification of less than 0.2 v/v %.

The outlet wet crude stream 228 is fed into the HPDD 210 for desalting and dehydration, the dehydration made possible by the VIEC component of the HPDD 210. Prior to being fed into the HPDD 210, the outlet wet crude stream 228 may optionally be injected with wash water 230, which is mixed with the outlet wet crude stream 228 using a mixing valve **230*a*. Injection of the wash water 230 may be configured to meet a salt content concentration of less than 10 pounds per thousand barrels (PTB) for feeding into the HPDD 210**, while maintaining the BS&W requirement of 0.2 v/v % or less.

The HPDD 210 produces an outlet gas stream 232, an outlet water stream 234, and an outlet wet crude stream 236. The HPDD 210 may be configured to separate additional gas from the HPHT outlet wet crude stream 228 with little pressure drop at the inlet of the HPDD 210 for the purpose of mixing the wash water 230 with the outlet wet crude stream 228, whereas normal mixing requires a 10-15 psi pressure drop. The HPDD 210 further advantageously handles receipt of the outlet wet crude stream 228 (and wash water 230) while meeting a salt content concentration of less than 10 pounds per thousand barrels (PTB) for further downstream processing while maintaining the BS&W requirement of 0.2 v/v % or less.

The outlet wet crude stream 236 is desalted and dehydrated and may be fed to a high-pressure crude stabilizer (HPSC) 242 where it is stripped of volatile components and stabilized to produce a stabilized crude stream 240, as described below. As used herein, the term "stabilized," and grammatical variants thereof, refers to lowering the vapor pressure and thus volatile components of a crude oil to facilitate tank storage and pipeline transport. The stabilization may be, for example, to lower the vapor pressure of a crude oil to at least 13 pounds per square inch (psi) or less at 37.8° C. so that vapor will generally not flash under atmospheric conditions and to reduce volatile components, such as to reduce $H_2S$ to an industry specification content of less than about 60 ppm wt., particularly in the case of sour crude, or in the range of about 10 ppm wt. to about 60 ppm. wt., encompassing any value and subset therebetween. In some instances, the stabilization reduces the volatile components, such as to reduce $H_2S$ to an industry specification content of less than about 10 ppm wt.

The temperature and number of column tray/stages of the stabilizer 242 may be determined using process simulation software, such as ASPEN-HYSYS (AspenTech, Massachusetts) to achieve the aforementioned stabilized crude stream qualities. Where a very high stabilizer 242 temperature is required in order to meet stringent $H_2S$ content specifications, injection of non-regenerative $H_2S$ scavenger(s) 250, such as PETROSWEET™ HSO3507 (Baker Hughes, Texas), may be mixed with the produced stabilized crude stream 240 to support the $H_2S$ stripping.

The produced export grade crude stream 252 is finally cooled and flows at operating pressure without the need for additional pumping to its export Terminal or Refinery destination (not shown).

In some embodiments, the gas streams 212, 224, and 232 are comingled and otherwise combined in an optional ejector 254. The ejector 254 utilizes the Venturi effect based on Bernoulli's principle of a converging-diverging nozzle to convert the energy of the higher-pressure gas stream 212 to velocity energy, which creates a low pressure zone within the ejector 254 that draws in and entrains the lower-pressure gas streams 224, 232. A mixture 256 of the gas streams 212, 224, and 232 may then be discharged from the ejector 254 and conveyed to a gas processing plant without any need for additional pressurization.

The water streams 214, 226, and 234 may be conveyed to a Water-Oil Separator (WOSEP) 248 to remove the remaining oil content to less than 100 ppm, and discharge a water stream 246 that may be injected back into a subterranean reservoir for water-flooding and/or pressure maintenance.

The HPHT-GOSP 200 may be operable to beneficiate/separate wild/crude oil to produce a stabilized export crude oil product safe for storage and shipment and meeting the following specifications: (1) a salt concentration of not more than about 10 pound (lbs.) of salt/1000 barrels (PTB); (2) basic sediment and water (BS&W) of not more than about 0.2 volume percent (V %); (3) $H_2S$ concentration of less than about 60 ppm (in the range of 10 ppm to 60 ppm); and (4) a maximum true vapor pressure (TVP) of about 13 psia at 37.8° C. Advantageously, the HPHT-GOSP 200 may be capable of achieving the foregoing specifications without utilizing rotating equipment, which is common to gas-oil separation plants. Rather, the equipment of the HPHT-GOSP 200 comprise static pressure vessels.

Further, the HPHT-GOSP comprises a limited number of major process equipment, including: (1) a ILS system having three phases and operating as a slug catcher; (2) a wet-dry crude heat exchanger (with or without an extra crude heater); (3) a HPHT-VIEC; (4) a HPDD-VIEC; and (5) a high-pressure stabilization column (HPSC).

In addition to the aforementioned major process equipment, the HPHT-GOSP may further include the following utility systems: (1) steam/hot oil from solar concentrator/molten salt technology for crude oil heating in the HPHT-GOSP; (2) wash water storage and circulation for use in crude oil desalting; (3) chemical injection packages (e.g., demulsifier, corrosion inhibitor, scale inhibitor, $H_2S$ Scavenger, and the like); (4) a utility and fire water system; (5) a relief and flare system; (6) a fuel gas system; (7) power generation; and (8) utility & instrument air and nitrogen systems.

Accordingly, the HPHT-GOSP of the present disclosure serves stringent economic challenges in the oil and gas industry and the need for energy conservation and net-zero emissions targets.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, as used herein, the terms "coupled" or "coupled to" or "connected" or "connected to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The invention claimed is:

1. A compact high-pressure high-temperature gas oil separation plant system, the system comprising:

an inline separator device (ILS) that receives a wild crude oil and separates a portion of gas and water from the wild crude oil and discharges an ILS outlet crude stream;

a wet-dry heat exchanger for heating the ILS outlet crude stream, thereby producing an exchanger outlet crude stream;

a three-phase high-pressure high-temperature (HPHT) separator that receives and separates gas and water from the exchanger outlet crude stream to achieve a Basic Sediment & Water specification of 0.2 v/v % or less, and thereby producing an HPHT outlet crude stream;

a high-pressure desalter and dehydrator (HPDD) that receives, separates gas, desalts, and dehydrates the HPHT outlet crude stream, thereby producing an HPDD outlet crude stream and an outlet gas stream; and a high-pressure stabilization column that receives and stabilizes the HPDD outlet crude stream, thereby producing an export grade crude stream.

2. The system of claim 1, wherein the ILS comprises three phases and functions as a slug catcher.

3. The system of claim 1, wherein the HPHT separator includes a Vessel Internal Electrostatic Coalescer (VIEC) operable to separate water-in-emulsion from the exchanger outlet crude stream.

4. The system of claim 1, wherein the HPDD includes a Vessel Internal Electrostatic Coalescer (VIEC) operable to dehydrate the HPHT outlet crude stream.

5. The system of claim 1, further comprising an ejector that receives corresponding gas streams discharged from the ILS, the HPHT, and the HPDD, the ejector being configured to discharge a mixture of the corresponding gas streams and convey the mixture downstream.

6. The system of claim 1, wherein the export crude stream has a salt concentration of less than about 10 pounds (lbs.) of salt/1000 barrels.

7. The system of claim 1, wherein the export crude stream has Basic Sediment & Water specification of less than about 0.2 v/v %.

8. The system of claim 1, wherein the export crude stream has a H2S concentration of less than about 60 ppm.

9. The system of claim 1, wherein the export crude stream has a maximum true vapor pressure of about 13 psia at 37.8° C.

10. A method comprising:

introducing a wild crude oil to an inline separator device (ILS) and thereby operating the ILS to separate gas and water from the wild crude oil and produce an ILS outlet crude stream;

conveying the ILS outlet crude stream through a wet-dry heat exchanger and thereby heating the ILS outlet crude stream and producing an exchanger outlet crude stream;

separating gas and water from the exchanger outlet crude stream in a three-phase high-pressure high-temperature (HPHT) separator and thereby producing an HPHT outlet crude stream that exhibits a Basic Sediment & Water specification of 0.2 v/v % or less;

desalting and dehydrating the HPHT outlet crude stream in a high-pressure desalter and dehydrator (HPDD) and thereby producing an HPDD outlet crude stream;

separating gas from the HPHT outlet crude stream in the HPDD and thereby producing a gas stream;

stabilizing the HPDD outlet stream in a high-pressure stabilization column; and discharging an export grade crude stream from the high-pressure stabilization column.

11. The method of claim 10, wherein the ILS comprises three phases and functions as a slug catcher, and further comprising collecting slug with the ILS.

12. The method of claim 10, further comprising separating both water-in-emulsion from the exchanger outlet crude stream with a Vessel Internal Electrostatic Coalescer (VIEC) included in the HPHT separator.

13. The method of claim 10, further comprising dehydrating the HPHT outlet crude stream with a Vessel Internal Electrostatic Coalescer (VIEC) included in the HPDD.

14. The method of claim 10, further comprising:

receiving corresponding gas streams discharged from the ILS, the HPHT, and the HPDD at an ejector; and discharging a mixture of the corresponding gas streams from the ejector and conveying the mixture downstream.

15. The method of claim 10, further comprising introducing a demulsifier to the exchanger outlet crude stream.

16. The method of claim 10, wherein a pressure let down between introducing the wild crude into the ILS and discharging the expert grade crude stream is less than 30%.

17. The system of claim 1, wherein the system operates with less than 30% let down in pressure between a pressure of the wild crude and the export grade crude stream.

18. A compact high-pressure high-temperature gas oil separation plant system, the system comprising:

an inline separator device (ILS) that receives a wild crude oil and separates gas and water from the wild crude oil, thereby producing a first outlet crude stream, a first outlet water stream, and a first outlet gas stream;

a wet-dry heat exchanger for heating the first outlet crude stream, thereby producing a second outlet crude stream;

a three-phase separator that receives and separates gas and water from the second outlet crude stream to achieve a Basic Sediment & Water specification of 0.2 v/v % or less, thereby producing a third outlet crude stream;

a desalter and dehydrator unit that receives the third outlet crude stream, the desalter and dehydrator unit being configured to separate gas from the third outlet crude stream to produce a second outlet gas stream, desalt the third outlet crude stream, and dehydrate the third outlet crude stream to produce a fourth outlet crude stream and a second outlet water steam; and a stabilization column that receives and stabilizes the fourth outlet crude stream, thereby producing a fifth outlet crude stream.

19. The system of claim 18, further comprising an ejector fluidly coupled to the first and second outlet gas streams, wherein the ejector mixes the first and second outlet gas streams to produce a mixed gas stream.

20. The system of claim 18, further comprising an injector operable to inject a non-regenerative $H_2S$ scavenger into the fifth outlet crude stream after the fifth outlet crude stream is utilized by the wet-dry exchanger to heat the first outlet crude stream.

* * * * *